US008797369B2

(12) United States Patent
Choi

(10) Patent No.: US 8,797,369 B2
(45) Date of Patent: Aug. 5, 2014

(54) ORGANIC LIGHT EMITTING DISPLAY

(75) Inventor: Sang-Moo Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 255 days.

(21) Appl. No.: 13/103,671

(22) Filed: May 9, 2011

(65) Prior Publication Data

US 2012/0105495 A1 May 3, 2012

(30) Foreign Application Priority Data

Oct. 28, 2010 (KR) ..... 10-2010-0105794

(51) Int. Cl.
*G09G 5/10* (2006.01)

(52) U.S. Cl.
USPC ..... 345/690; 345/204; 345/76

(58) Field of Classification Search
CPC ..... G09G 2300/0842; G09G 2300/0814; G09G 2300/0861; G09G 2310/0262
USPC ..... 345/76–84; 315/169.3
See application file for complete search history.

(56) References Cited

U.S. PATENT DOCUMENTS

| | | | | |
|---|---|---|---|---|
| 7,564,452 | B2 * | 7/2009 | Komiya | 345/204 |
| 7,760,164 | B2 * | 7/2010 | Shin | 345/76 |
| 8,223,094 | B2 * | 7/2012 | Nakamura et al. | 345/78 |
| 8,237,637 | B2 * | 8/2012 | Chung | 345/80 |
| 2004/0263503 | A1 * | 12/2004 | Seki | 345/204 |
| 2005/0110730 | A1 * | 5/2005 | Kim et al. | 345/82 |
| 2006/0055336 | A1 * | 3/2006 | Jeong | 315/169.3 |
| 2006/0097966 | A1 * | 5/2006 | Choi | 345/77 |
| 2006/0244388 | A1 * | 11/2006 | Chung | 315/169.3 |
| 2006/0279499 | A1 * | 12/2006 | Park et al. | 345/92 |
| 2007/0024540 | A1 * | 2/2007 | Ryu et al. | 345/76 |
| 2008/0018381 | A1 * | 1/2008 | Shin | 327/536 |
| 2008/0111804 | A1 * | 5/2008 | Choi et al. | 345/205 |
| 2008/0150846 | A1 * | 6/2008 | Chung | 345/80 |
| 2009/0225011 | A1 * | 9/2009 | Choi | 345/77 |

(Continued)

FOREIGN PATENT DOCUMENTS

| | | | | |
|---|---|---|---|---|
| EP | 1675094 | * 12/2005 | ..... | G09G 3/32 |
| KR | 1020040019207 A | 3/2004 | | |

(Continued)

OTHER PUBLICATIONS

Improve OLED Technology for Display by Jennifer Y. Yu, Ph.D Dissertation, Massachusetts Institute of Technology, Sep. 2008, 151 pages.*

(Continued)

*Primary Examiner* — Alexander Eisen
*Assistant Examiner* — Chun-Nan Lin
(74) *Attorney, Agent, or Firm* — Christie, Parker & Hale, LLP

(57) ABSTRACT

An organic light emitting display capable of displaying an image with uniform brightness is provided. The display includes a scan driver, a data driver, pixels, an initial power source line coupled to an initial power source, a bias power source line coupled to a bias power source, horizontal power lines, first switching elements, and second switching elements. Each of the pixels includes a driving transistor for controlling an amount of current that flows from a first power source. The bias power source has a different voltage from the initial power source. The first switching elements are coupled between the horizontal power source lines and the initial power source line. The second switching elements are coupled between the horizontal power source lines and the bias power source line. The second switching elements are configured to alternately turn on and off with the first switching elements.

21 Claims, 4 Drawing Sheets

(56) References Cited

U.S. PATENT DOCUMENTS

| | | | | |
|---|---|---|---|---|
| 2009/0243976 | A1* | 10/2009 | Choi | 345/76 |
| 2009/0256785 | A1* | 10/2009 | Sung et al. | 345/77 |
| 2009/0271650 | A1* | 10/2009 | Choi et al. | 713/340 |

FOREIGN PATENT DOCUMENTS

| | | | |
|---|---|---|---|
| KR | 1020050005646 | A | 1/2005 |
| KR | 1020060135749 | A | 12/2006 |
| KR | 1020080060967 | A | 7/2008 |

OTHER PUBLICATIONS

Thin Film Transistor Integration for Biomedical Imaging and AMOLED Display by Reza Chaji, Ph.D Dissertation, University of Waterloo, 2008, 177 pages.*

* cited by examiner

ORGANIC LIGHT EMITTING DISPLAY

CROSS-REFERENCE TO RELATED APPLICATION

This application claims priority to and the benefit of Korean Patent Application No. 10-2010-0105794, filed on Oct. 28, 2010, in the Korean Intellectual Property Office, the entire content of which is incorporated herein by reference.

BACKGROUND

1. Field

Aspects of embodiments according to the present invention relate to an organic light emitting display.

2. Description of Related Art

Recently, various flat panel displays (FPDs) with reduced weight and volume compared to that of cathode ray tube (CRT) devices have been developed. The FPDs include, for example, a liquid crystal display (LCD), a field emission display (FED), a plasma display panel (PDP), and an organic light emitting display.

Among the FPDs, the organic light emitting display displays an image using organic light emitting diodes (OLEDs) that generate light by re-combination of electrons and holes. The organic light emitting display has high response speed and is driven with low power consumption.

The organic light emitting display includes a plurality of pixels. It has been determined through experimentation that in the organic light emitting display, deterioration of a response characteristic in the pixels is caused by the characteristics of the driving transistors included in the pixels. In more detail, the threshold voltages of the driving transistors are shifted to correspond to the voltages applied to the driving transistors in a previous frame period. Consequently, light with desired brightness is not generated by the current frame due to the shifted threshold voltages.

SUMMARY

Accordingly, embodiments of the present invention provide for an organic light emitting display capable of displaying an image with uniform or improved uniformity of brightness.

In an exemplary embodiment according to the present invention, an organic light emitting display is provided. The organic light emitting display includes a scan driver, a data driver, pixels, an initial power source line, a bias power source line, horizontal power source lines, first switching elements, and second switching elements. The scan driver is for supplying a first scan signal to first scan lines, for supplying a second scan signal to second scan lines, and for supplying emission control signals to emission control lines. The data driver is for supplying data signals to data lines. The pixels are at crossing regions of the first scan lines and the data lines. Each of the pixels includes a driving transistor. The driving transistor is for controlling an amount of current that flows from a first power source to an organic light emitting diode (OLED) in accordance with one of the data signals. The initial power source line is coupled to an initial power source. The bias power source line is coupled to a bias power source. The bias power source has a different voltage from that of the initial power source. The horizontal power source lines extend in parallel with and corresponding to the first scan lines. The first switching elements are coupled between the horizontal power source lines and the initial power source line. The second switching elements are coupled between the horizontal power source lines and the bias power source line. The second switching elements are configured to alternately turn on and off with the first switching elements.

The initial power source may have a lower voltage than the data signals.

The bias power source may have a higher voltage than a voltage obtained by subtracting a threshold voltage of the driving transistor from a voltage of the first power source.

The data driver may be configured to supply the data signals concurrently with the first scan signal.

The scan driver may be configured to supply two second-scan signals to the second scan lines in one frame.

The scan driver may be further configured to supply the first scan signal to one of the first scan lines after supplying a second of the two second-scan signals to a corresponding one of the second scan lines.

The scan driver may be further configured to supply one of the emission control signals to one of the emission control lines to overlap a second of the two second-scan signals supplied to a corresponding one of the second scan lines and to overlap the first scan signal supplied to a corresponding one of the first scan lines.

The organic light emitting display may further include first control lines coupled to the first switching elements, second control lines coupled to the second switching elements, and a switching driver for supplying a first control signal to the first control lines (for turning on the first switching elements) and a second control signal to the second control lines (for turning on the second switching elements).

The switching driver may be configured to supply the first control signal to one of the first control lines to overlap one of the emission control signals supplied to the one of the emission control lines.

The switching driver may be configured to supply the second control signal to one of the second control lines to overlap a first of the two second-scan signals supplied to the corresponding one of the second scan lines.

Each of the pixels may further include the OLED and a second transistor coupled between a gate electrode of the driving transistor and one of the horizontal power source lines, the second transistor being configured to turn on when the second scan signal is supplied to a corresponding one of the second scan lines.

Each of the pixels may further include a third transistor, a fourth transistor, a fifth transistor, a sixth transistor, and a capacitor. The third transistor is coupled between a second electrode of the driving transistor and the gate electrode of the driving transistor. The third transistor is configured to turn on when the first scan signal is supplied to a corresponding one of the first scan lines. The fourth transistor is coupled between a first electrode of the driving transistor and one of the data lines. The fourth transistor is configured to turn on when the first scan signal is supplied to the corresponding one of the first scan lines. The fifth transistor is coupled between the first electrode of the driving transistor and the first power source. The fifth transistor is configured to turn off when one of the emission control signals is supplied to a corresponding one of the emission control lines. The sixth transistor is coupled between the second electrode of the driving transistor and the OLED. The sixth transistor is configured to turn off when the one of the emission control signals is supplied to the corresponding one of the emission control lines. The storage capacitor is coupled between the gate electrode of the driving transistor and the first power source.

According to another exemplary embodiment of the present invention, an organic light emitting display is provided. The organic light emitting display includes a scan driver, a data driver, pixels, an initial power source line, a bias power source line, horizontal power source lines, first switching elements, and second switching elements. The scan driver is for supplying scan signals to scan lines and for supplying emission control signals to emission control lines. The data driver is for supplying data signals to data lines. The pixels are at crossing regions of the scan lines and the data lines. Each of the pixels includes a driving transistor. The driving transistor is for controlling an amount of current that flows from a first power source to an organic light emitting diode (OLED) in accordance with one of the data signals. The initial power source line is coupled to an initial power source. The bias power source line is coupled to a bias power source. The bias power source has a different voltage from that of the initial power source. The horizontal power source lines extend in parallel with and corresponding to the scan lines. The first switching elements are coupled between the horizontal power source lines and the initial power source line. The second switching elements are coupled between the horizontal power source lines and the bias power source line. The second switching elements are configured to alternately turn on and off with the first switching elements.

The initial power source may have a lower voltage than the data signals.

The bias power source may have a higher voltage than a voltage obtained by subtracting a threshold voltage of the driving transistor from a voltage of the first power source.

The scan driver may be configured to supply two scan signals to the scan lines in one frame.

The scan driver may be further configured to supply one of the emission control signals to one of the emission control lines to overlap one of the scan signals supplied to a corresponding one of the scan lines and to overlap the one of the scan signals supplied to a corresponding previous one of the scan lines.

The organic light emitting display may further include first control lines coupled to the first switching elements, second control lines coupled to the second switching elements, and a switching driver for supplying a first control signal to the first control lines (for turning on the first switching elements) and a second control signal to the second control lines (for turning on the second switching elements).

The switching driver may be configured to supply the second control signal to one of the second control lines to overlap a first of the two scan signals supplied to the corresponding one of the scan lines and to the corresponding previous one of the scan lines, and to supply the first control signal to one of the first control lines to overlap a second of the two scan signals supplied to the corresponding one of the scan lines and to the corresponding previous one of the scan lines.

Each of the pixels may further include the OLED and a second transistor coupled between a gate electrode of the driving transistor and one of the horizontal power source lines, the second transistor being configured to turn on when one of the scan signals is supplied to a corresponding previous one of the scan lines.

Each of the pixels may further include a third transistor, a fourth transistor, a fifth transistor, a sixth transistor, and a capacitor. The third transistor is coupled between a second electrode of the driving transistor and the gate electrode of the driving transistor. The third transistor is configured to turn on when the one of the scan signals is supplied to a corresponding one of the scan lines. The fourth transistor is coupled between a first electrode of the driving transistor and one of the data lines. The fourth transistor is configured to turn on when the one of the scan signals is supplied to the corresponding one of the scan lines. The fifth transistor is coupled between the first electrode of the driving transistor and the first power source. The fifth transistor is configured to turn off when one of the emission control signals is supplied to a corresponding one of the emission control lines. The sixth transistor is coupled between the second electrode of the driving transistor and the OLED. The sixth transistor is configured to turn off when the one of the emission control signals is supplied to the corresponding one of the emission control lines. The storage capacitor is coupled between the gate electrode of the driving transistor and the first power source.

In an organic light emitting display according to an embodiment of the present invention, an off bias voltage is applied to the driving transistors included in the pixels before the pixels emit light. When the off bias voltage is applied to the driving transistors, the characteristics of the driving transistors are initialized to a uniform state so that an image with uniform brightness is displayed.

BRIEF DESCRIPTION OF THE DRAWINGS

The accompanying drawings, together with the specification, illustrate exemplary embodiments of the present invention, and, together with the description, serve to explain aspects and principles of the present invention.

DETAILED DESCRIPTION

Figure 1:
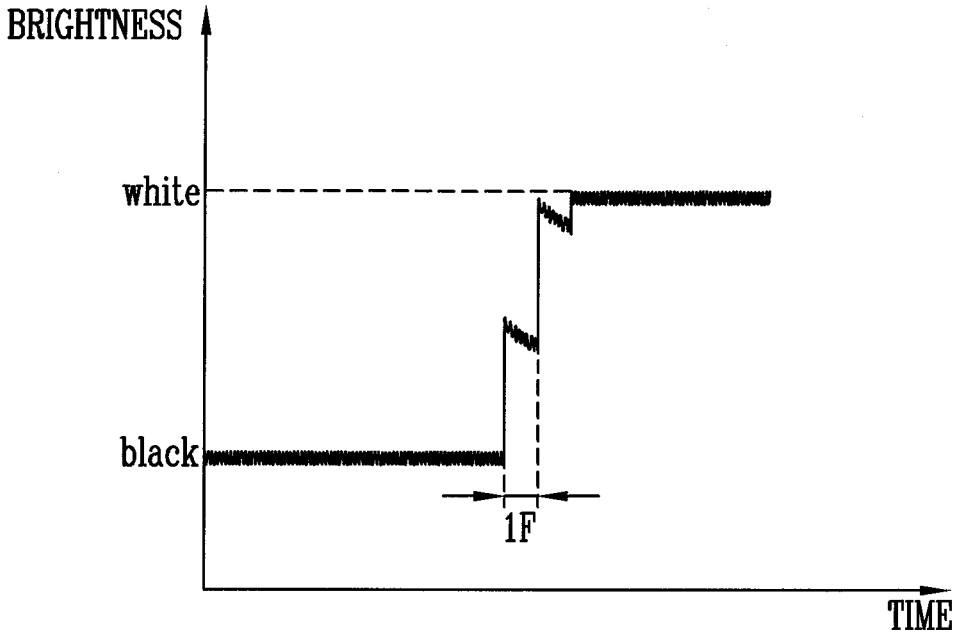
FIG. 1 is a graph illustrating brightness of a pixel of an organic light emitting display when white gray levels are displayed after black gray levels.

Hereinafter, certain exemplary embodiments according to the present invention will be described with reference to the accompanying drawings. Here, when a first element is described as being coupled to a second element, the first element may be directly coupled (for example, connected) to the second element or may be indirectly coupled (for example, electrically connected) to the second element via one or more third elements. Further, some of the elements that are not essential to a complete understanding of embodiments of the invention may be omitted for clarity. In addition, like reference numerals refer to like elements throughout.

An exemplary organic light emitting display includes a plurality of pixels arranged in a matrix at the crossing regions of a plurality of data lines, scan lines, and power source lines. The pixels commonly include organic light emitting diodes (OLEDs) and driving transistors for driving the amount of current that flows to the OLEDs. The pixels generate light with brightness (for example, predetermined brightness) while supplying current from the driving transistors to the OLEDs in accordance with data signals.

However, as illustrated in FIG. 1, in the pixels of some organic light emitting display devices, when white gray levels are displayed after displaying black gray levels, for about two frame periods, light with lower brightness than desired brightness is generated. In this case, an image with desired brightness is not displayed to correspond to the intended gray levels by the pixels so that uniformity of brightness deteriorates and that picture quality of moving pictures deteriorates.

Embodiments by which those skilled in the art may practice the present invention will be described with reference to FIGS. 2 to 6.

Figure 2:
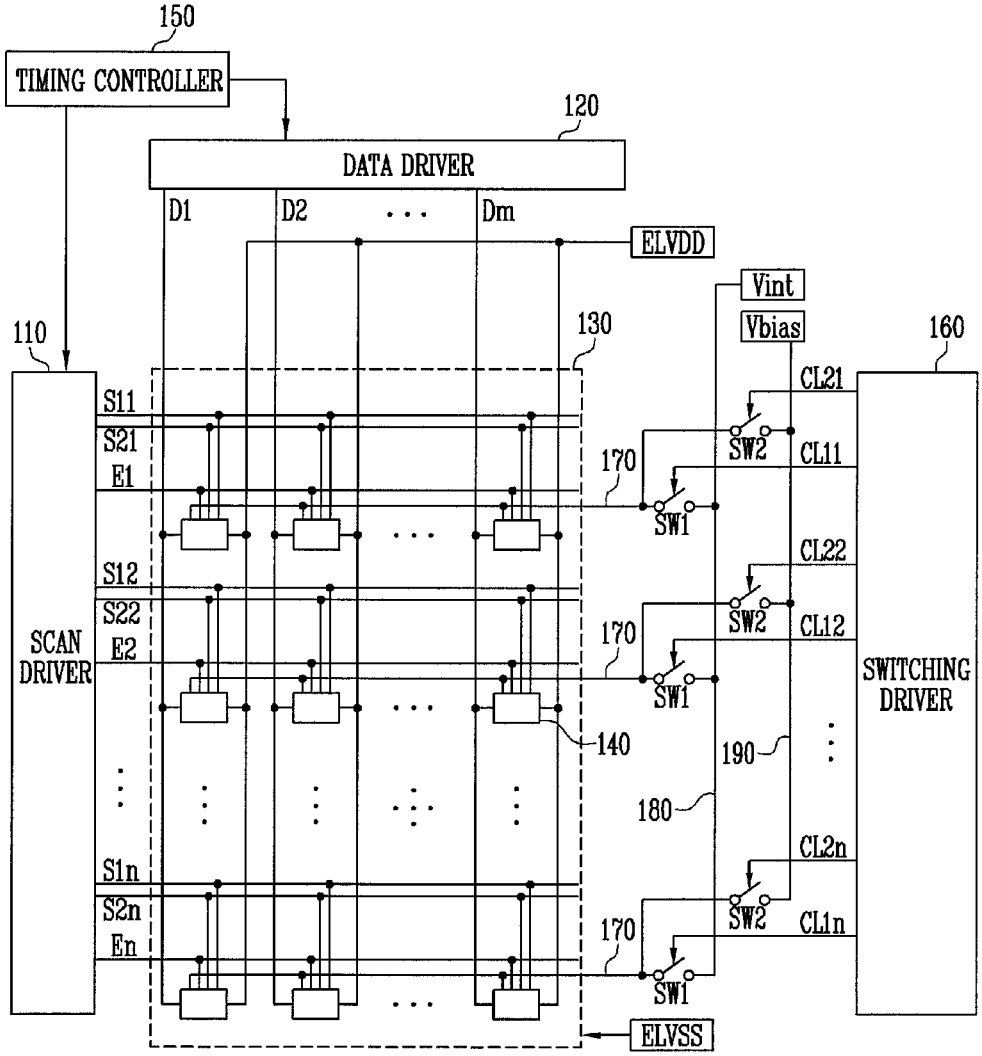
FIG. 2 is a view illustrating an organic light emitting display according to an embodiment of the present invention.

FIG. 2 is a view illustrating an organic light emitting display according to an embodiment of the present invention.

Referring to FIG. 2, the organic light emitting display includes a display unit 130 including pixels 140 coupled to first scan lines S11 to S1n, and data lines D1 to Dm, a scan driver 110 for driving the first scan lines S11 to S1n, second scan lines S21 to S2n, and emission control lines E1 to En, a data driver 120 for driving the data lines D1 to Dm, and a timing controller 150 for controlling the scan driver 110 and the data driver 120.

In addition, the organic light emitting display of FIG. 2 includes horizontal power source lines 170 extending in parallel with and corresponding to the first scan lines S11 to S1n, an initial power source line 180 coupled to an initial power source Vint outside of the display unit 130, a bias power source line 190 coupled to a bias power source Vbias outside of the display unit 130, first switching elements SW1 coupled between the horizontal power source lines 170 and the initial power source line 180, second switching elements SW2 coupled between the horizontal power source lines 170 and the bias power source line 190, and a switching driver 160 for supplying a first control signal to first control lines CL11 to CL1n, and for supplying a second control signal to second control lines CL21 to CL2n.

The scan driver 110 sequentially supplies a first scan signal to the first scan lines S11 to S1n, and sequentially supplies a second scan signal to the second scan lines S21 to S2n. In one frame, the first scan lines S11 to S1n, receive the first scan signal once and the second scan lines S21 to S2n, receive the second scan signal twice.

During the frame, when the first of two second-scan signals is supplied to the second scan lines S21 to S2n, the pixels 140 receive the voltage of the bias power source Vbias. When the second of two second-scan signals is supplied to the second scan lines S21 to S2n, the pixels 140 receive the voltage of the initial power source Vint. When the first scan signal is supplied to the first scan lines S11 to S1n, the pixels 140 receive data signals. The first scan signal is supplied to an ith first scan line S1i positioned in the ith (i is a natural number) horizontal line after the second of two second-scan signals is supplied to the ith second scan line S2i, positioned in the ith horizontal line.

In addition, the scan driver 110 supplies an emission control signal to an ith emission control line Ei to overlap the second of two second-scan signals supplied to the ith second scan line S2i, and to overlap the first scan signal supplied to the ith first scan line S1i. The first scan signal and the second scan signal are set to have voltages (for example, at a low level) for which the transistors included in the pixels 140 are turned on while emission control signals are set to have voltages (for example, at a high level) for which the transistors are turned off.

The data driver 120 supplies the data signals to the data lines D1 to Dm concurrently (for example, in synchronization) with the first scan signal supplied to the first scan lines S11 to S1n. The timing controller 150 controls the scan driver 110 and the data driver 120. The timing controller 150 realigns data supplied from an external source and transmits the data to the data driver 120.

The switching driver 160 sequentially supplies the first control signal to the first control lines CL11 to CL1 n and sequentially supplies the second control signal to the second control lines CL21 to CL2n. The first control signal supplied to the first control lines CL11 to CL1 n is supplied to the first switching elements SW1 and the second control signal supplied to the second control lines CL21 to CL2n, is supplied to the second switching elements SW2.

The first control signal supplied to the ith first control line CL1i does not overlap the second control signal supplied to the ith second control line CL2i, so that the turn on times of the first switching elements SW1 and the second switching elements SW2 do not overlap. For example, in one embodiment, the first control signal supplied to the ith first control line CL1i, overlaps the emission control signal supplied to the ith emission control line Ei while the second control signal supplied to the ith second control line CL2i, overlaps the first of two second-scan signals supplied to the ith second scan line S2i.

The initial power source line 180 is formed outside of the display unit 130 and is coupled to the initial power source Vint. The initial power source Vint is for controlling the voltages of the gate electrodes of the driving transistors included in the pixels 140 and is set to have a lower voltage than the data signals.

The bias power source line 190 is formed outside of the display unit 130 and is coupled to the bias power source Vbias. The bias power source Vbias is for applying an off bias to the driving transistors included in the pixels 140 and is set to have a higher voltage than the voltage obtained by subtracting the threshold voltages of the driving transistors from a first power source voltage ELVDD.

The horizontal power source lines 170 are formed every horizontal line and coupled to the pixels 140. The horizontal power source lines 170 are coupled to the initial power source Vint when the first switching elements SW1 are turned on and are coupled to the bias power source Vbias when the second switching elements SW2 are turned on.

The first switching elements SW1 are coupled between the horizontal power source lines 170 and the initial power source line 180. The first switching elements SW1 are turned on and turned off to correspond to (for example, in accordance with) the first control signal.

The second switching elements SW2 are coupled between the horizontal power source lines 170 and the bias power source line 190. The second switching elements SW2 are alternately turned on and off with the first switching elements SW1 to correspond to (for example, in accordance with) the second control signal.

The display unit 130 includes the pixels 140 positioned at the crossing regions of the first scan lines S11 to S1n, and the data lines D1 to Dm. The pixels 140 generate light with brightness (for example, predetermined brightness) to correspond to (for example, in accordance with) the data signals.

Figure 3:
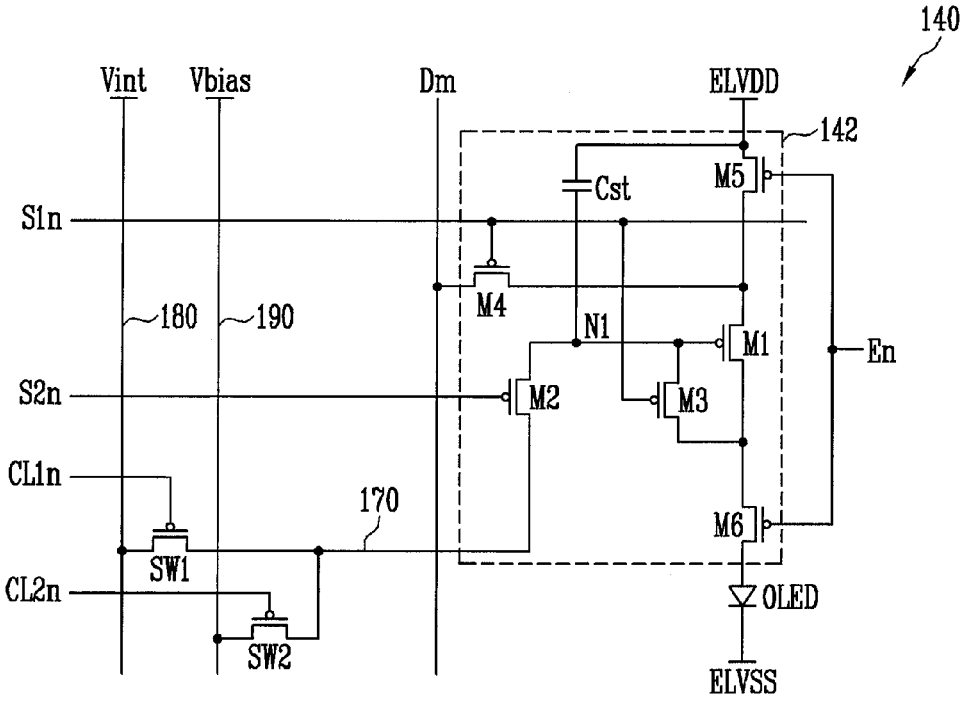
FIG. 3 is a view illustrating an embodiment of one of the pixels of FIG. 2.

FIG. 3 is a view illustrating an embodiment of one of the pixels 140 of FIG. 2.

Referring to FIG. 3, the pixel 140 includes an OLED and a pixel circuit 142 for controlling the amount of current supplied to the OLED. The anode electrode of the OLED is coupled to the pixel circuit 142 and the cathode electrode of the OLED is coupled to a second power source ELVSS. The OLED generates light with brightness (for example, predetermined brightness) to correspond to the current supplied from the pixel circuit 142.

The pixel circuit 142 controls the amount of current supplied to the OLED. The pixel circuit 142 includes first to sixth transistors M1 to M6 and a storage capacitor Cst.

The first electrode of the first transistor M1 (the driving transistor) is coupled to the second electrode of the fifth transistor M5. The second electrode of the first transistor M1 is coupled to the first electrode of the sixth transistor M6. The gate electrode of the first transistor M1 is coupled to a first node N1. The first transistor M1 controls the amount of current supplied to the OLED to correspond to the voltage applied to the first node N1.

The first electrode of the second transistor M2 is coupled to the first node N1. The second electrode of the second transistor M2 is coupled to the horizontal power source line 170. The gate electrode of the second transistor M2 is coupled to the second scan line S2n. The second transistor M2 is turned on when the second scan signal is supplied to the second scan line S2n, to electrically couple the first node N1 to the horizontal power source 170.

The first electrode of the third transistor M3 is coupled to the second electrode of the first transistor M1. The second electrode of the third transistor M3 is coupled to the first node N1. The gate electrode of the third transistor M3 is coupled to the first scan line S1n. The third transistor M3 is turned on when the first scan signal is supplied to the first scan line S1n, to diode-connect the first transistor M1.

The first electrode of the fourth transistor M4 is coupled to the data line Dm. The second electrode of the fourth transistor M4 is coupled to the first electrode of the first transistor M1. The gate electrode of the fourth transistor M4 is coupled to the first scan line S1n. The fourth transistor M4 is turned on when the first scan signal is supplied to the first scan line Sin to electrically couple the data line Dm to the first electrode of the first transistor M1.

The first electrode of the fifth transistor M5 is coupled to the first power source ELVDD. The second electrode of the fifth transistor M5 is coupled to the first electrode of the first transistor M1. The gate electrode of the fifth transistor M5 is coupled to an emission control line En. The fifth transistor M5 is turned off when an emission control signal is supplied to the emission control line En and is turned on in the other periods.

The first electrode of the sixth transistor M6 is coupled to the second electrode of the first transistor M1. The second electrode of the sixth transistor M6 is coupled to the anode electrode of the OLED. The gate electrode of the sixth transistor M6 is coupled to the emission control line En. The sixth transistor M6 is turned off when the emission control signal is supplied to the emission control line En and is turned on in the other periods.

The storage capacitor Cst is coupled between the first node N1 and the first power source ELVDD. The storage capacitor Cst charges a voltage (for example, a predetermined voltage) to correspond to (for example, in accordance with) a data signal.

In other embodiments, the structure of the pixel circuit 142 may differ from the structure of FIG. 3. For example, the pixel circuit 142 may be changed into various types that include the first transistor M1 and the second transistor M2.

Figure 4:
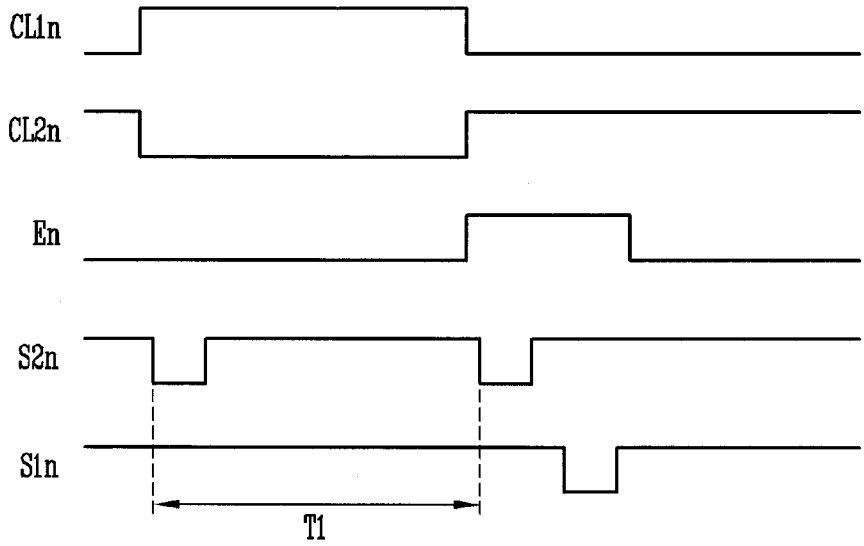
FIG. 4 is a waveform chart illustrating a method of driving the pixel of FIG. 3.

FIG. 4 is a waveform chart illustrating a method of driving the pixel of FIG. 3.

Referring to FIG. 4, the second control signal is supplied to the second control line CL2n, and the first of two second-scan signals is supplied to the second scan line S2n. When the second control signal is supplied to the second control line CL2n, the second switching element SW2 is turned on. When the second switching element SW2 is turned on, the voltage of the bias power source Vbias is supplied to the horizontal power source line 170.

When the second scan signal is supplied to the second scan line S2n , the second transistor M2 is turned on. When the second transistor M2 is turned on, the first node N1 and the horizontal power source line 170 are electrically coupled to each other so that the voltage of the bias power source Vbias is supplied to the first node N1. When the voltage of the bias power source Vbias is supplied to the first node N1, the first transistor M1 is turned off. At this time, since the fifth transistor M5 and the sixth transistor M6 are turned on, the first transistor M1 is initialized to an off bias state.

Further, the voltage of the bias power source Vbias supplied to the first node N1 is charged in the storage capacitor Cst. Therefore, the first transistor M1 maintains the off bias state in a first period T1.

After the first period T1, the supply of the second control signal to the second control line CL2n, is stopped while the supply of the first control signal to the first control line CL1n, is started. The emission control signal is supplied to the emission control line En concurrently (for example, at the same time) with the first control signal being supplied to the first control line CL1n, and concurrently with the second of two second-scan signals being supplied to the second scan line S2n.

When the first control signal is supplied to the first control line CL1n, the first switching element SW1 is turned on. When the first switching element SW1 is turned on, the voltage of the initial power source Vint is supplied to the horizontal power source line 170.

When the emission control signal is supplied to the emission control line En, the fifth transistor M5 and the sixth transistor M6 are turned off. When the fifth transistor M5 is turned off, the first transistor M1 and the first power source ELVDD are electrically isolated from each other. When the sixth transistor M6 is turned off, the first transistor M1 and the second power source ELVSS are electrically isolated from each other.

When the second of two second-scan signals is supplied to the second scan line S2n , the second transistor M2 is turned on. When the second transistor M2 is turned on, the first node N1 and the horizontal power source line 170 are electrically coupled to each other so that the voltage of the initial power source Vint is supplied to the first node Ni.

Then, the first scan signal is supplied to the first scan line S1n. When the first scan signal is supplied to the first scan line S1n, the third transistor M3 and the fourth transistor M4 are turned on. When the third transistor M3 is turned on, the first node N1 and the second electrode of the first transistor M1 are electrically coupled to each other so that the first transistor M1 is diode-connected.

When the fourth transistor M4 is turned on, the data line Dm and the first electrode of the first transistor M1 are electrically coupled to each other and the data signal from the data line Dm is supplied to the first electrode of the first transistor M1. At this time, since the first node N1 is initialized by the voltage of the initial power source Vint, which is lower than the data signal, the first transistor M1 is turned on. When the first transistor M1 is turned on, the voltage obtained by subtracting the threshold voltage of the first transistor M1 from the data signal is applied to the first node N1.

The storage capacitor Cst charges the voltage corresponding to the difference of the first power source voltage ELVDD and the voltage applied to the first node N1.

Then, the supply of the emission control signal to the emission control line En is stopped so that the fifth transistor M5 and the sixth transistor M6 are turned on. When the fifth transistor M5 and the sixth transistor M6 are turned on, a current path is formed from the first power source ELVDD to the second power source ELVSS via the first transistor M1 and the OLED. The first transistor M1 controls the amount of current supplied from the first power source ELVDD to the OLED to correspond to the voltage applied to the first node N1, that is, the voltage charged in the storage capacitor Cst.

According to the above-described embodiment, the off bias voltage is applied to the first transistor M1 before the data signal is supplied to the storage capacitor Cst. When the off bias voltage is applied to the first transistor M1, the characteristic curve (or the threshold voltage) of the first transistor M1 is initialized to a uniform state. That is, the first transistor M1 included in each of the pixels 140 is initialized to display the black gray level. In this case, when the white gray levels are displayed in the next frame, light with the same brightness is generated by all of the pixels 140 so that an image with uniform brightness may be displayed.

In addition, the first period T1 is no less than a two horizontal period 2H (where a horizontal period 1H corresponds to the time between applying data signals to consecutive horizontal lines of the display unit 130). In some circumstances, when the off bias voltage that is applied to the first transistor M1 is for a period less than 2H, the characteristics of the first transistors M1 included in the pixels 140 may not be initialized to a uniform state. Therefore, the first period T1 is no less than 2H so that the characteristics of the first transistors M1 are initialized to the uniform state. Then, the upper limit of the first period T1 is determined by experiments. That is, the upper limit of the first period T1 is determined by experiments considering the size and resolution of a panel. For example, in a specific panel, the first period T1 may be set to a period between no less than 2H and no more than half of one frame.

Figure 5:
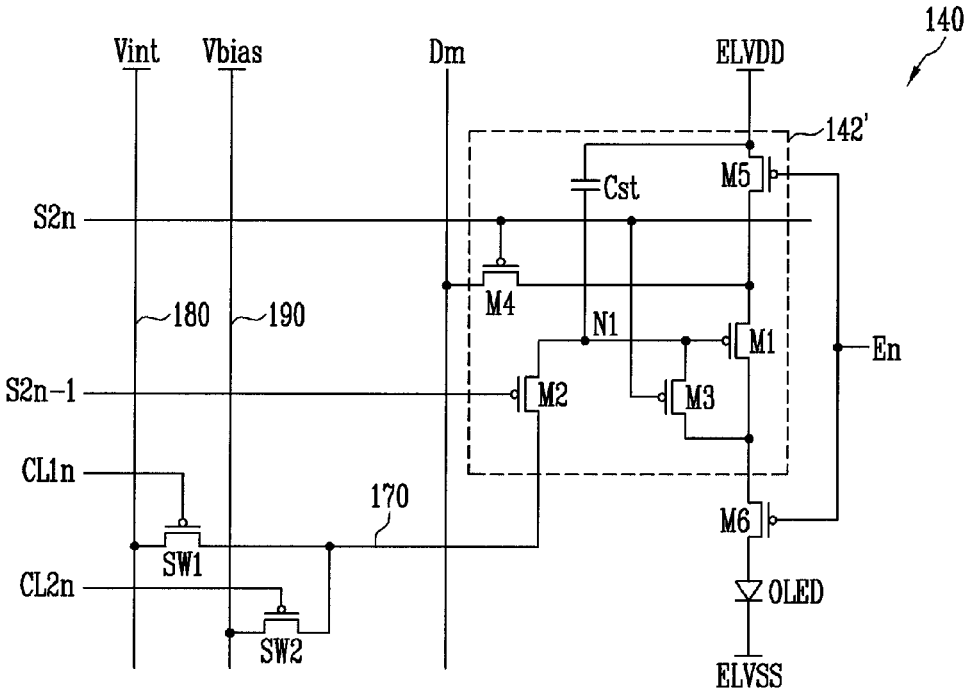
FIG. 5 is a view illustrating another embodiment of one of the pixels of FIG. 2.

FIG. 5 is a view illustrating another embodiment of one of the pixels 140 of FIG. 2. When FIG. 5 is described, the same elements as those of FIG. 3 are denoted by the same reference numerals and detailed description thereof may not be repeated.

Referring to FIG. 5, the pixel 140 includes an OLED and a pixel circuit 142' for controlling the amount of current supplied to the OLED.

The gate electrodes of the third and fourth transistors M3 and M4 included in the pixel circuit 142' are coupled to the nth second scan line S2n. The gate electrode of the second transistor M2 is coupled to the (n−1)th second scan line S2n−1. The coupling structure of the transistors M1 to M6 included in the pixel circuit 142' is the same as that of the pixel circuit 142 illustrated in FIG. 3. In this case, the first scan line S1n, illustrated in FIG. 3 is removed so that the circuit structure may be simplified.

The emission control signal supplied to the nth emission control line En overlaps the second scan signals supplied to the (n−1)th second scan line S2n−1, and the nth second scan line S2n. Since two second-scan signals are supplied to each of the second scan lines S21 to S2n, in one frame, two emission control signals are supplied to the emission control line En, as illustrated in FIG. 6.

Figure 6:
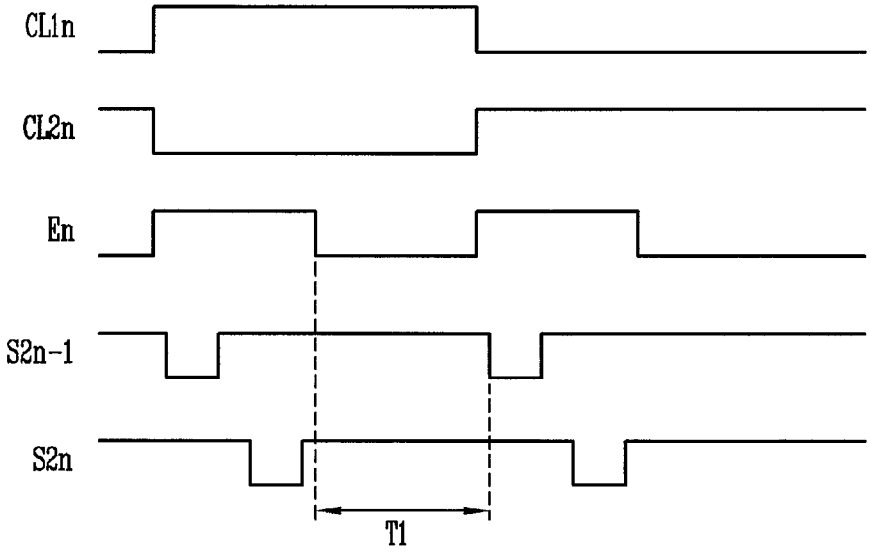
FIG. 6 is a waveform chart illustrating a method of driving the pixel of FIG. 5.

FIG. 6 is a waveform chart illustrating a method of driving the pixel of FIG. 5. In FIG. 6, the second control signal is supplied to the nth second control line CL2n, to overlap the first of two second-scan signals supplied to the (n−1)th second scan line S2n−1, and the nth second scan line S2n. In addition, the first control signal is supplied to the nth first control line CL1n, to overlap the second of two second-scan signals supplied to the (n−1)th second scan line S2n−1, and the nth second scan line S2n.

Referring to FIG. 6, the second control signal is supplied to the second control line CL2n, and the first of two second-scan signals is supplied to the (n−1)th second scan line S2n−1. The emission control signal is supplied to the nth emission control line En. When the emission control signal is supplied to the nth emission control line En, the fifth transistor M5 and the sixth transistor M6 are turned off.

When the second control signal is supplied to the second control line CL2n, the second switching element SW2 is turned on. When the second switching element SW2 is turned on, the voltage of the bias power source Vbias is supplied to the horizontal power source line 170.

When the first of two second-scan signals is supplied to the (n−1)th second scan line S2n−1, the second transistor M2 is turned on. When the second transistor M2 is turned on, the first node N1 and the horizontal power source line 170 are electrically coupled so that the voltage of the bias power source Vbias is supplied to the first node N1. When the voltage of the bias power source Vbias is supplied to the first node N1, the first transistor M1 is turned off. At this time, the storage capacitor Cst charges a voltage (for example, a predetermined voltage) to correspond to the voltage applied to the first node N1.

After the voltage of the bias power source Vbias is supplied to the first node N1, the first of two second-scan signals is supplied to the nth second scan line S2n. When the first of two second-scan signals is supplied to the nth second scan line S2n, the fourth transistor M4 and the third transistor M3 are turned on.

When the fourth transistor M4 is turned on, the data signal from the data line Dm is supplied to the first electrode of the first transistor M1. When the third transistor M3 is turned on, the first transistor M1 is diode-connected. At this time, the voltage of the first node N1 is set to the voltage of the bias power source Vbias so that the first transistor M1 remains turned off.

Then, the supply of the emission control signal to the nth emission control line En is stopped so that the fifth transistor M5 and the sixth transistor M6 are turned on. In this case, the first transistor M1 is initialized to an off bias state to correspond to the voltage of the bias power source Vbias applied to the first node N1.

After the first transistor M1 is set to the off bias state in a first period T1, the supply of the second control signal to the second control line CL2n, is stopped and the first control signal is supplied to the first control line CL1n. When the first control signal is supplied to the first control line CL1n, the emission control signal is supplied to the emission control line En and the second of two second-scan signals is supplied to the (n−1)th second scan line S2n−1.

When the first control signal is supplied to the first control line CL1n, the first switching element SW1 is turned on. When the first switching element SW1 is turned on, the voltage of the initial power source Vint is supplied to the horizontal power source line 170.

When the emission control signal is supplied to the emission control line En, the fifth transistor M5 and the sixth transistor M6 are turned off. When the second of two second-scan signals is supplied to the (n−1)th second scan line S2n−1, the second transistor M2 is turned on. When the second transistor M2 is turned on, the first node N1 and the horizontal power source line 170 are electrically coupled to each other so that the voltage of the initial power source Vint is supplied to the first node N1.

Then, the second of two second-scan signals is supplied to the nth second scan line S2n, so that the third transistor M3 and the fourth transistor M4 are turned on. When the third transistor M3 is turned on, the first node N1 and the second electrode of the first transistor M1 are electrically coupled to each other so that the first transistor M1 is diode-connected.

When the fourth transistor M4 is turned on, the data line Dm and the first electrode of the first transistor M1 are electrically coupled to each other, and the data signal from the data line Dm is supplied to the first electrode of the first transistor M1. At this time, since the first node N1 is initialized to the voltage of the initial power source Vint, which is lower than the data signal, the first transistor M1 is turned on. When the first transistor M1 is turned on, the voltage obtained by subtracting the threshold voltage of the first transistor M1 from the data signal is applied to the first node N1.

The storage capacitor Cst charges the voltage corresponding to the difference of the first power source voltage ELVDD and the voltage applied to the first node N1.

Then, the supply of the emission control signal to the emission control line En is stopped so that the fifth transistor M5 and the sixth transistor M6 are turned on. When the fifth transistor M5 and the sixth transistor M6 are turned on, a current path is formed from the first power source ELVDD to the second power source ELVSS via the first transistor M1 and the OLED. At this time, the first transistor M1 controls the amount of current supplied from the first power source ELVDD to the OLED to correspond to the voltage applied to the first node N1, that is, the voltage charged in the storage capacitor Cst.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a scan driver for supplying a first scan signal to first scan lines, a second scan signal to second scan lines, and emission control signals to emission control lines;

a data driver for supplying data signals to data lines;

an initial power source line coupled to an initial power source;

a bias power source line coupled to a bias, power source having a different voltage from that of the initial power source;

pixels at crossing regions of the data lines and horizontal power source lines extending in parallel with and corresponding to the first scan lines, the horizontal power source lines being configured to couple the pixels to the initial power source and the bias power source, each of the pixels comprising a driving transistor for controlling an amount of current that flows from a first power source to an organic light emitting diode (OLED) in accordance with one of the data signals;

first switching elements coupled between the horizontal power source lines and the initial power source line, each of the first switching elements comprising one terminal connected to one of the horizontal power source lines and another terminal connected to the initial power source line; and second switching elements coupled between the horizontal power source lines and the bias power source line, the second switching elements being configured to alternately turn on and off with the first switching elements, each of the second switching elements comprising one terminal connected to one of the horizontal power source lines and another terminal connected to the bias power source line.

2. The organic light emitting display as claimed in claim 1, wherein the initial power source has a lower voltage than the data signals.

3. The organic light emitting display as claimed in claim 1, wherein the bias power source has a higher voltage than a voltage obtained by subtracting a threshold voltage of the driving transistor from a voltage of the first power source.

4. The organic light emitting display as claimed in claim 1, wherein the data driver is configured to supply the data signals concurrently with the first scan signal.

5. The organic light emitting display as claimed in claim 1, wherein the scan driver is configured to supply two second-scan signals to the second scan lines in one frame.

6. The organic light emitting display as claimed in claim 5, wherein the scan driver is further configured to supply the first scan signal to one of the first scan lines after supplying a second of the two second-scan signals to a corresponding one of the second scan lines.

7. The organic light emitting display as claimed in claim 5, wherein the scan driver is further configured to supply one of the emission control signals to one of the emission control lines to overlap a second of the two second-scan signals supplied to a corresponding one of the second scan lines and to overlap the first scan signal supplied to a corresponding one of the first scan lines.

8. The organic light emitting display as claimed in claim 7, further comprising:

first control lines coupled to the first switching elements;

second control lines coupled to the second switching elements; and a switching driver for supplying:

a first control signal to the first control lines for turning on the first switching elements; and a second control signal to the second control lines for turning on the second switching elements.

9. The organic light emitting display as claimed in claim 8, wherein the switching driver is configured to supply the first control signal to one of the first control lines to overlap the one of the emission control signals supplied to the one of the emission control lines.

10. The organic light emitting display as claimed in claim 8, wherein the switching driver is configured to supply the second control signal to one of the second control lines to overlap a first of the two second-scan signals supplied to the corresponding one of the second scan lines.

11. The organic light emitting display as claimed in claim 1, wherein each of the pixels further comprises:

the OLED; and a second transistor coupled between a gate electrode of the driving transistor and one of the horizontal power source lines, the second transistor being configured to turn on when the second scan signal is supplied to a corresponding one of the second scan lines.

12. The organic light emitting display as claimed in claim 11, wherein each of the pixels further comprises:

a third transistor coupled between a second electrode of the driving transistor and the gate electrode of the driving transistor, the third transistor being configured to turn on when the first scan signal is supplied to a corresponding one of the first scan lines;

a fourth transistor coupled between a first electrode of the driving transistor and one of the data lines, the fourth transistor being configured to turn on when the first scan signal is supplied to the corresponding one of the first scan lines;

a fifth transistor coupled between the first electrode of the driving transistor and the first power source, the fifth transistor being configured to turn off when one of the emission control signals is supplied to a corresponding one of the emission control lines;

a sixth transistor coupled between the second electrode of the driving transistor and the OLED, the sixth transistor being configured to turn off when the one of the emission control signals is supplied to the corresponding one of the emission control lines; and a storage capacitor coupled between the gate electrode of the driving transistor and the first power source.

13. An organic light emitting display comprising:

a scan driver for supplying scan signals to scan lines and for supplying emission control signals to emission control lines;

a data driver for supplying data signals to data lines;

an initial power source line coupled to an initial power source;

a bias power source line coupled to a bias power source having a different voltage from that of the initial power source;

pixels at crossing regions of the data lines and horizontal power source lines extending in parallel with and corresponding to the scan lines, the horizontal power source lines being configured to couple the pixels to the initial power source and the bias power source, each of the pixels comprising a driving transistor for controlling an amount of current that flows from a first power source to an organic light emitting diode (OLED) in accordance with one of the data signals;

first switching elements coupled between the horizontal power source lines and the initial power source line, each of the first switching elements comprising one terminal connected to one of the horizontal power source lines and another terminal connected to the initial power source line; and second switching elements coupled between the horizontal power source lines and the bias power source line, the second switching elements being configured to alternately turn on and off with the first switching elements, each of the second switching elements comprising one terminal connected to one of the horizontal power source lines and another terminal connected to the bias power source line.

14. The organic light emitting display as claimed in claim 13, wherein the initial power source has a lower voltage than the data signals.

15. The organic light emitting display as claimed in claim 13, wherein the bias power source has a higher voltage than a voltage obtained by subtracting a threshold voltage of the driving transistor from a voltage of the first power source.

16. The organic light emitting display as claimed in claim 13, wherein the scan driver is configured to supply two scan signals to the scan lines in one frame.

17. The organic light emitting display as claimed in claim 16, wherein the scan driver is further configured to supply one of the emission control signals to one of the emission control lines to overlap one of the scan signals supplied to a corresponding one of the scan lines and to overlap the one of the scan signals supplied to a corresponding previous one of the scan lines.

18. The organic light emitting display as claimed in claim 17, further comprising:

first control lines coupled to the first switching elements;

second control lines coupled to the second switching elements; and a switching driver for supplying:

a first control signal to the first control lines for turning on the first switching elements; and a second control signal to the second control lines for turning on the second switching elements.

19. The organic light emitting display as claimed in claim 18, wherein the switching driver is configured to supply:

the second control signal to one of the second control lines to overlap a first of the two scan signals supplied to the corresponding one of the scan lines and to the corresponding previous one of the scan lines; and the first control signal to one of the first control lines to overlap a second of the two scan signals supplied to the corresponding one of the scan lines and to the corresponding previous one of the scan lines.

20. The organic light emitting display as claimed in claim 13, wherein each of the pixels further comprises:

the OLED; and a second transistor coupled between a gate electrode of the driving transistor and one of the horizontal power source lines, the second transistor being configured to turn on when one of the scan signals is supplied to a corresponding previous one of the scan lines.

21. The organic light emitting display as claimed in claim 20, wherein each of the pixels further comprises:

a third transistor coupled between a second electrode of the driving transistor and the gate electrode of the driving transistor, the third transistor being configured to turn on when the one of the scan signals is supplied to a corresponding one of the scan lines;

a fourth transistor coupled between a first electrode of the driving transistor and one of the data lines, the fourth transistor being configured to turn on when the one of the scan signals is supplied to the corresponding one of the scan lines;

a fifth transistor coupled between the first electrode of the driving transistor and the first power source, the fifth transistor being configured to turn off when one of the emission control signals is supplied to a corresponding one of the emission control lines;

a sixth transistor coupled between the second electrode of the driving transistor and the OLED, the sixth transistor being configured to turn off when the one of the emission control signals is supplied to the corresponding one of the emission control lines; and a storage capacitor coupled between the gate electrode of the driving transistor and the first power source.

* * * * *